US009626817B2

(12) United States Patent
Thompson et al.

(10) Patent No.: US 9,626,817 B2
(45) Date of Patent: Apr. 18, 2017

(54) APPARATUSES, SYSTEMS, AND METHODS FOR STORING AND DISPENSING MEDICATION PROXIMATE A PATIENT

(71) Applicant: Aesynt Incorporated, Cranberry, PA (US)

(72) Inventors: Jeff Thompson, Allison Park, PA (US); David Deutsch, Cranberry Township, PA (US); Preeti Churbock, Pittsburgh, PA (US); Kevon Garrison, Rocky Point, NC (US); John Barickman, West Chester, PA (US); Bruce Thompson, Pittsburgh, PA (US); Randy Rossi, Greensburg, PA (US); Gregoire Aby-Eva, Pittsburgh, PA (US); Jeremy O'Halloran, Pittsburgh, PA (US)

(73) Assignee: Aesynt Incorporated, Cranberry, PA (US)

( * ) Notice: Subject to any disclaimer, the term of this patent is extended or adjusted under 35 U.S.C. 154(b) by 199 days.

(21) Appl. No.: 13/853,171

(22) Filed: Mar. 29, 2013

(65) Prior Publication Data

US 2014/0292476 A1 Oct. 2, 2014

(51) Int. Cl.
*G07C 9/00* (2006.01)

(52) U.S. Cl.
CPC ..... *G07C 9/00896* (2013.01)

(58) Field of Classification Search
CPC combination set(s) only.
See application file for complete search history.

(56) References Cited

U.S. PATENT DOCUMENTS

| | | | |
|---|---|---|---|
| 4,717,042 | A | 1/1988 | McLaughlin |
| 4,785,969 | A | 11/1988 | McLaughlin |
| 4,847,764 | A | 7/1989 | Halvorson |
| 5,014,875 | A | 5/1991 | McLaughlin et al. |
| 5,190,185 | A | 3/1993 | Blechl |
| 5,314,243 | A | 5/1994 | McDonald et al. |
| 5,346,297 | A | 9/1994 | Colson, Jr. et al. |
| 5,377,864 | A | 1/1995 | Blechl et al. |
| 5,405,048 | A | 4/1995 | Rogers et al. |
| 5,431,299 | A | 7/1995 | Brewer et al. |
| 5,460,294 | A | 10/1995 | Williams |
| 5,468,110 | A | 11/1995 | McDonald et al. |
| 5,480,062 | A | 1/1996 | Rogers et al. |
| 5,520,450 | A | 5/1996 | Colson, Jr. et al. |

(Continued)

*Primary Examiner* — Brian Zimmerman
*Assistant Examiner* — Cal Eustaquio
(74) *Attorney, Agent, or Firm* — Alston & Bird LLP

(57) ABSTRACT

Provided herein are various apparatuses, systems, and methods for improving the efficiency of medication distribution within a healthcare facility. In particular, embodiments may provide for storing and dispensing medications to an authorized medical person for administration to a patient in a healthcare facility. A storage and dispensing system may include a housing defining a cavity, a door movable between an open and a closed position to provide access to the cavity, two or more receivers disposed within the cavity, a lock to lock the door in the closed position, and a user interface configured to receive a request for medications stored within the cavity. The medications may be configured to be presented to a user in response to a request for the medications, while unrequested medications remain inaccessible.

20 Claims, 8 Drawing Sheets

(56) References Cited

U.S. PATENT DOCUMENTS 5,564,803 A 10/1996 McDonald et al.
5,593,267 A 1/1997 McDonald et al.
5,661,978 A 9/1997 Holmes et al.
D384,578 S 10/1997 Wangu et al.
5,713,485 A 2/1998 Liff et al.
5,716,114 A 2/1998 Holmes et al.
5,745,366 A 4/1998 Higham et al.
5,761,877 A 6/1998 Quandt
5,797,515 A 8/1998 Liff et al.
5,805,456 A 9/1998 Higham et al.
5,842,976 A 12/1998 Williamson
5,878,885 A 3/1999 Wangu et al.
5,880,443 A 3/1999 McDonald et al.
5,883,806 A 3/1999 Meador et al.
5,893,697 A 4/1999 Zini et al.
5,905,653 A 5/1999 Higham et al.
5,912,818 A 6/1999 McGrady et al.
5,927,540 A 7/1999 Godlewski
5,940,306 A 8/1999 Gardner et al.
5,971,593 A 10/1999 McGrady
6,003,006 A 12/1999 Colella et al.
6,011,999 A 1/2000 Holmes
6,021,392 A 2/2000 Lester et al.
6,039,467 A 3/2000 Holmes
6,065,819 A 5/2000 Holmes et al.
6,068,156 A 5/2000 Liff et al.
6,109,774 A 8/2000 Holmes et al.
6,112,502 A 9/2000 Frederick et al.
6,116,461 A 9/2000 Broadfield et al.
6,131,399 A * 10/2000 Hall ..... 62/127
6,151,536 A 11/2000 Arnold et al.
6,170,230 B1 1/2001 Chudy et al.
6,176,392 B1 1/2001 William et al.
6,189,727 B1 2/2001 Shoenfeld
6,223,934 B1 5/2001 Shoenfeld
6,233,327 B1 5/2001 Petite
6,256,967 B1 7/2001 Hebron et al.
6,263,674 B1 * 7/2001 Fileman et al. ..... 60/641.9
6,283,322 B1 9/2001 Liff et al.
6,289,656 B1 9/2001 Wangu et al.
6,338,007 B1 1/2002 Broadfield et al.
6,339,732 B1 1/2002 Phoon et al.
6,361,263 B1 3/2002 Dewey et al.
6,370,841 B1 4/2002 Chudy et al.
6,449,927 B2 9/2002 Hebron et al.
6,471,089 B2 10/2002 Liff et al.
6,497,342 B2 12/2002 Zhang et al.
6,499,270 B2 12/2002 Peroni et al.
6,529,446 B1 * 3/2003 de la Huerga ..... A61J 7/0084 368/10
6,532,399 B2 3/2003 Mase
6,564,121 B1 5/2003 Wallace et al.
6,581,798 B2 6/2003 Liff et al.
6,609,047 B1 8/2003 Lipps
6,611,733 B1 8/2003 De La Huerga
6,625,952 B1 9/2003 Chudy et al.
6,640,159 B2 10/2003 Holmes et al.
6,650,964 B2 11/2003 Spano, Jr. et al.
6,671,579 B2 12/2003 Spano, Jr. et al.
6,681,149 B2 1/2004 William et al.
6,742,671 B2 6/2004 Hebron et al.
6,755,931 B2 6/2004 Vollm et al.
6,760,643 B2 7/2004 Lipps
6,776,304 B2 8/2004 Liff et al.
6,785,589 B2 8/2004 Eggenberger et al.
6,790,198 B1 9/2004 White et al.
6,814,254 B2 11/2004 Liff et al.
6,814,255 B2 11/2004 Liff et al.
6,847,861 B2 1/2005 Lunak et al.
6,874,684 B1 4/2005 Denenberg et al.
6,892,780 B2 5/2005 Vollm et al.
6,895,304 B2 5/2005 Spano, Jr. et al.
6,975,922 B2 12/2005 Duncan et al.
6,985,797 B2 1/2006 Spano, Jr. et al.
6,996,455 B2 2/2006 Eggenberger et al.
7,010,389 B2 3/2006 Lunak et al.
7,014,063 B2 3/2006 Shows et al.
7,016,766 B2 3/2006 William et al.
7,040,504 B2 5/2006 Broadfield et al.
7,052,097 B2 5/2006 Meek, Jr. et al.
7,072,737 B2 7/2006 Lunak et al.
7,072,855 B1 7/2006 Godlewski et al.
7,077,286 B2 7/2006 Shows et al.
7,085,621 B2 8/2006 Spano, Jr. et al.
7,092,796 B2 8/2006 Vanderveen
7,093,755 B2 8/2006 Jordan et al.
7,100,792 B2 9/2006 Hunter et al.
7,103,419 B2 9/2006 Engleson et al.
7,111,780 B2 9/2006 Broussard et al.
7,139,639 B2 11/2006 Broussard et al.
7,150,724 B2 12/2006 Morris et al.
7,171,277 B2 1/2007 Engleson et al.
7,218,231 B2 5/2007 Higham
7,228,198 B2 6/2007 Vollm et al.
7,249,688 B2 7/2007 Hunter et al.
7,348,884 B2 3/2008 Higham
7,417,729 B2 8/2008 Greenwald
7,419,133 B2 9/2008 Clarke et al.
7,426,425 B2 9/2008 Meek, Jr. et al.
7,554,449 B2 6/2009 Higham
7,571,024 B2 8/2009 Duncan et al.
7,588,167 B2 9/2009 Hunter et al.
2007/0157657 A1 * 7/2007 Fogerty ..... 62/457.2

* cited by examiner

APPARATUSES, SYSTEMS, AND METHODS FOR STORING AND DISPENSING MEDICATION PROXIMATE A PATIENT

TECHNOLOGICAL FIELD

Embodiments of the present invention relate generally to the storage and dispensing of medication and supplies proximate a patient for whom the medication or supplies are intended. In particular, embodiments may provide a method and apparatus for receiving medications or supplies and controlling access to the contents.

BACKGROUND

Medication dispensing in healthcare facilities can be a complex and time consuming process. In order for patients to have their medications and supplies when they are required, an authorized medical person may have to retrieve the medication or supplies and deliver them to the patient. The authorized medical person may also have to administer the medication or configure the supplies for use as necessary.

"Titratables," or intravenous titratable medications, also referred to as "drips," rarely run on a prescribed schedule such that it may be difficult to estimate when a patient may need an intravenous medication. Having authorized healthcare personnel check on a patient's medication status, check a patient's prescribed medication status, request medication from a central pharmacy, and retrieve a medication from a central pharmacy can be very time consuming and may significantly impact the efficiency of healthcare personnel. Further, quality of care may be reduced by inefficient practices if healthcare personnel are preoccupied with requesting and obtaining medications for a patient rather than administering them and speaking with a patient. As such, it may be desirable to improve the efficiency with which medications are dispensed to a patient, particularly intravenous medications.

SUMMARY

Embodiments of the present invention may provide various apparatuses, systems, and methods for improving the efficiency of medication distribution within a healthcare facility. In particular, embodiments may provide for storing and dispensing medications to an authorized medical person for administration to a patient in a healthcare facility.

An apparatus according to an example embodiment of the present invention may include a housing defining a cavity, a door, two or more receivers disposed within the cavity, a lock configured to lock the door in the closed position, and a user interface configured to receive a request from a user. The door may be configured to be movable between an open position and a closed position relative to the housing, where in the open position; the cavity of the housing is accessible. Each receiver may be configured to hold an article for a patient, where each of the receivers may be movable between an accessible position in which the contents of the receiver are accessible, and an inaccessible position in which the contents of the receiver are inaccessible. The request from the user may identify the contents of one of the receivers. In response to the request received at the user interface, the door may be configured to be unlocked. The receiver including the contents identified by the request may be configured to be moved to the accessible position in response to the door being moved to the open position. The one or more receivers not including the contents identified by the request may be configured to remain in the inaccessible position.

According to some embodiments, the receiver including the contents identified by the request may be engaged by the door, and the receiver including the contents identified by the request is moved to the accessible position as the door is moved to the open position. The user interface may be configured to receive a restock request to access each of the two or more receivers disposed within the cavity, and in response to the restock request to access each of the two or more receivers, each of the receivers may be configured to move to the accessible position in response to the door moving to the open position.

An apparatus according to some example embodiments may include two or more windows in the door, where each of the two or more windows corresponds to one of the two or more receivers disposed within the cavity, and where the presence of the contents of each of the receivers may be visible through a respective window. Embodiments may include a photovoltaic panel disposed on the housing configured to charge a battery disposed within the housing. The user interface and the lock may be configured to be powered by the battery. The housing may optionally include a cooling pack receiver configured to receive a cooling pack therein. The housing may optionally include one or more ducts from the cooling pack receiver to a respective one or more of the two or more receivers for directing cooling air to one or more of the receivers.

Embodiments of an apparatus according to the present invention may further include a cooling pack configured to be received into a cooling pack receiver of the housing, where the cooling pack includes a passive, cold body and a powered fan configured to move air across the cold body and into the cavity of the housing. Embodiments may include a reader configured to read identifying indicia of an article to be received within a receiver of the apparatus. The reader may be configured to read identifying indicia of an article removed from a receiver of the apparatus. The apparatus may be configured to compare the identifying indicia of the article removed from a receiver of the apparatus to the request received at the user interface. The apparatus may be configured to provide an alert in response to the identifying indicia of the article matching the identity of an article of the request received at the user interface, where the notification includes at least one of an audible alert or a visual alert.

Embodiments of the present invention may include a method for improving the efficiency of storage and dispensing of articles such as medication in a healthcare facility. An example method may include receiving, at a housing, two or more articles where each article is received within a receiver within a cavity of the housing, where the articles are each received within a receiver arranged in an accessible position through a door arranged in an open position. Method may include securing the two or more articles in the housing, where securing may include arranging the receivers in an inaccessible position and locking the door in a closed position. Methods may further include receiving a request at a user interface of the housing for one of the two or more articles received within the housing, providing for unlocking of the door, and providing for release of the receiver including the requested article, where in response to the door being moved to the open position, the receiver including the requested article is moved to the accessible position. Methods may also include maintaining the receivers that do not contain the requested article in an inaccessible position.

According to some embodiments, receiving the two or more articles may include reading identifying indicia of each of the two or more articles and receiving a respective receiver identifier for the receiver into which each of the two or more articles are received. In response to receiving a request at a user interface for one of the articles, the method may provide for release of the receiver including the receiver identifier that corresponds to the one of the articles requested.

Methods of example embodiments may optionally include receiving an identifier of an article removed from the receiver including the requested article; comparing the identifier of the article removed to the one of the two or more articles requested, and providing a notification in response to the identifier of the article removed matching the one of the two or more articles requested. The notification may include at least one of an audible alert or a visual alert. Methods may include providing for cooling of at least one of the receivers in the cavity of the housing.

Embodiments of the present invention may provide a system for storing and dispensing articles such as medications in a healthcare facility. A system of example embodiments may include a housing defining a cavity and a cooling pack receiver, a door, a lock configured to lock the door in the closed position, a cooling pack configured to be received within the cooling pack receiver, and a user interface configured to receive a request from a user. The door may be configured to be movable between an open position and a closed position relative to the housing, where two or more articles for patients are received within the cavity, and where the articles are movable between an accessible position and an inaccessible position. The cooling pack may be configured to cool at least one of the two or more articles received within the cavity. The request received at the user interface may identify at least one of the two or more articles for patients. In response to the request received at the user interface, the door may be configured to be unlocked. At least one of the two or more articles for patients identified by the request may be configured to be moved to an accessible position in response to the door being moved to the open position. At least one of the two or more articles for patients that is not identified by the request may be maintained in an inaccessible position.

DESCRIPTION OF THE DRAWINGS

Reference now will be made to the accompanying drawings, which are not necessarily drawn to scale, and wherein.

DETAILED DESCRIPTION

Figure 1:
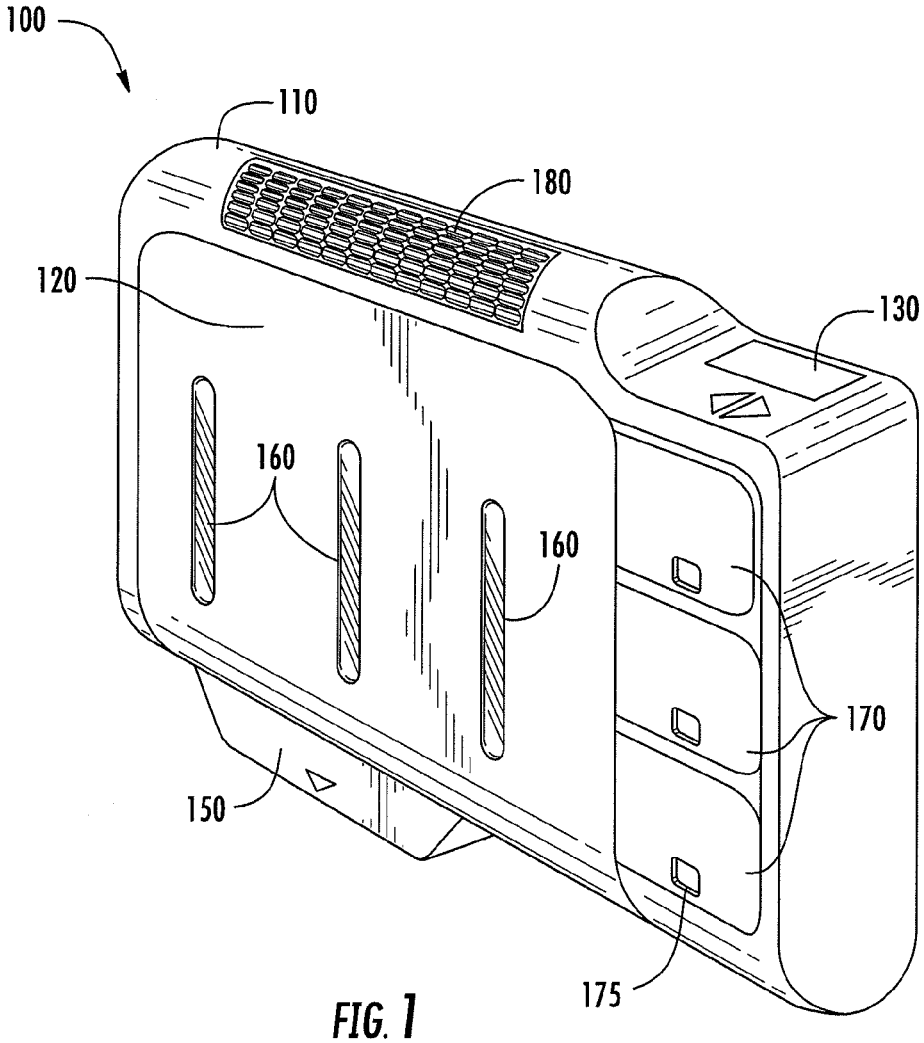
FIG. 1 illustrates a dispensing system according to an example embodiment of the present invention.

Embodiments of the present invention may provide various apparatuses, systems, and methods for improving the efficiency of medication distribution within a healthcare facility. Some embodiments and components of the present invention will now be described more fully hereinafter with reference to the accompanying drawings, in which some, but not all embodiments of the invention are shown. Indeed, various embodiments of the invention may be embodied in many different forms and should not be construed as limited to the embodiments set forth herein; rather, these embodiments are provided so that this disclosure will satisfy applicable legal requirements.

A technician or other authorized medical person may be required to deliver medications throughout a healthcare facility. Such a person is referred to herein generally as a technician. As the technician may be responsible for a large number of medications for a large number of patients, the distribution of the medications may take a considerable amount of time, and the arrival time of the technician at any particular patient's room may be uncertain. As such, medication may be delivered to patients throughout the facility ahead of the anticipated need. For example, the medications needed for all patients in a particular unit of a healthcare facility may all be delivered together maximizing distribution efficiency; however, the medications may not be ready to be administered upon arrival at the unit. It may be undesirable to store medication in a patient room awaiting administration as the medication may be tampered with, taken from the patient room, or otherwise misused. Therefore, secure storage of the medication may be desirable. However, secure storage at the nurse station may be inconvenient and may lead to additional inefficiencies of medication administration.

Embodiments of the present invention may be used for storage and distribution, and control of access to articles, such as intravenous bags within a healthcare facility. Embodiments may be implemented in any environment in which it is desirable to store, monitor access, control access, and dispense articles from a storage location. However, embodiments of the present invention are herein described with respect to healthcare facilities, such as hospitals, physicians' offices, healthcare clinics, and any other facility that manages and/or stores intravenous bags.

Embodiments of the present invention may be configured to provide secure, temporary storage of medications proximate a patient in a healthcare facility. The storage and dispensing system may provide easy and efficient access to medications for a patient, particularly medications and supplies for which timing may not be easily predicted, such as intravenous titratables or drip medications, as generally administered from intravenous bags. Embodiments may enable efficient, secure stocking of the storage unit while providing a secure dispensing method using medication and user authentication mechanisms to ensure accurate medication dispensing. Example embodiments may include a compact form factor which may be implemented in existing healthcare facilities and some embodiments may include power supplies, such as a battery, in the storage housing enabling installation without a hardwired infrastructure.

FIG. 1 illustrates an example embodiment of a system for storing and dispensing medication proximate a patient. The storage and dispensing system 100 of this example embodiment includes a housing 110 comprising a door 120. The housing 110 may be configured to be mounted to a wall, such as in or near the room of one or more patients in order to provide convenient, proximate storage of medications and to increase the efficiency of medication administration. The housing 110 may include a photovoltaic panel 180, which may be configured to charge a battery disposed within the housing 110. Optionally, a battery received within the housing may be configured to be removable for charging at a remote location and replaceable with a previously charged battery. In such embodiments including a battery, the housing may not require a power connection such that embodiments may be more easily installed in existing healthcare facilities. Optionally, embodiments may be configured to be hardwired to a power source. The power source may be a conventional 110V or 220 VAC source, or the system may be configured to operate off of a low power source, such as a low-voltage power line.

The storage and dispensing system housing 110 may include a user interface 130 and a scanner 150, as will be described further below. In addition to a primary door 120, some example embodiments may include secondary doors 170 as shown in FIG. 1. Each of the doors may be configured with windows 160, 175 arranged to allow a user to see the presence of contents of the system. Such windows provide a mechanism for determining if a storage and dispensing system has been loaded and if there are contents therein without requiring a sensor or other power consuming mechanism. Optionally, the storage and dispensing system may include a visual alert to indicate that the system has been loaded. For example, after the system has been accessed by a technician, a light emitting diode may illuminate to indicate that the system is loaded. Optionally, an alert may be provided to an authorized medical person responsible for administering the medication of the storage and dispensing system via a wireless signal received at a portable device, such as a pager, smart phone, nurse cart, or the like.

In practice, a technician may retrieve medications to be distributed throughout a healthcare facility, or to a unit of a healthcare facility. The medications may be retrieved from a central pharmacy as will be further detailed in an example below. The technician may deliver medications to patients' rooms using a cart or other means for transporting the medications. The medications for a particular patient's room or group of patients' rooms may be stored in bins or other containers to enable the technician to readily identify the medications for a particular room or group of rooms.

Upon arrival at a storage and dispensing system of example embodiments, such as the system illustrated in FIG. 1, the technician may first identify themselves. A technician may identify him/herself to a system of example embodiments through use of the user interface 130 and/or through the use of the scanner 150. The user interface may include a biometric scanner configured to perform a biometric scan (e.g., retina, finger print, hand geometry, palm vein, facial recognition, or voice analysis) to identify the technician. Optionally, the technician may enter a unique identification, such as a personal identification number (PIN) at the user interface to identify him/herself as an authorized medical person. A technician may additionally or alternatively identify him/herself through the presentation of identification credentials to the scanner 150. The identification credentials may include a barcode, radio frequency identification (RFID) tag, or other identifying indicia on an identification card, such as a badge which may be read by the scanner 150. The scanner may read the barcode, RFID tag, or other indicia to identify the technician. Additionally or alternatively, after scanning the identifying indicia, a technician may be required to enter a PIN or other identification at the user interface in order to confirm the identity of the scanned indicia.

Figure 2:
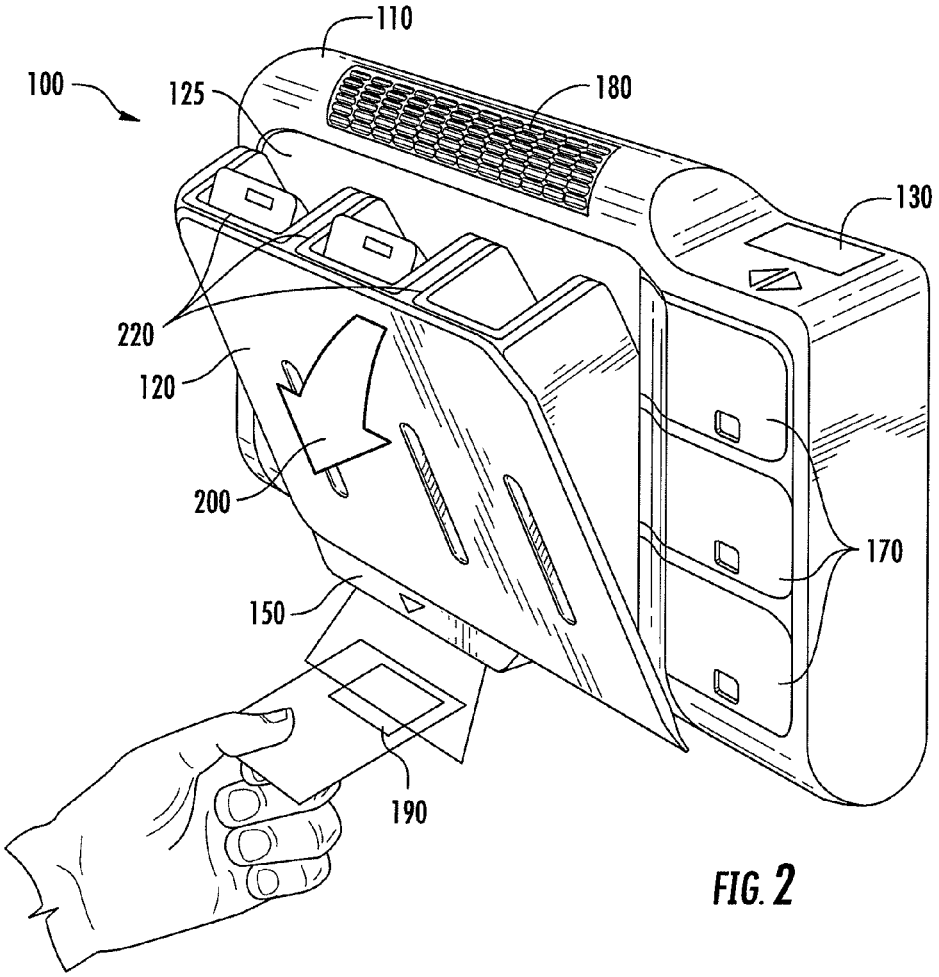
FIG. 2 illustrates the dispensing system of FIG. 1 with the door in the open position and all receivers in an accessible position according to an example embodiment of the present invention.

FIG. 2 illustrates the scanner 150 of an example embodiment scanning an identification card 190 including identifying indicia thereon. Upon identification of a properly authorized medical person, the door 120 may be unlocked. In some example embodiments, the door 120 may be configured to open automatically (e.g., along arrow 200) upon unlocking (e.g., through a biasing mechanism, an electric motor, etc.). The housing 110 may define a cavity 125 in which bins 220 are received. Each of the bins may be configured to receive an article (e.g., medication) therein. Each of the bins 220 may be received within a cradle of the door when the bins are presented in the accessible position shown in FIG. 2. While FIG. 2 illustrates each of the three depicted bins in the accessible position, wherein contents of the bins can be inserted or removed, the bins may be individually movable between the accessible position (shown), and an inaccessible position. As FIG. 2 illustrates a storage and dispensing system 100 accessed by a technician for purposes of loading medication to the system, each of the bins 220 may be accessed enabling efficient loading of the storage and dispensing system.

According to example embodiments, as will be described further below, the bins 220 may be individually retained within the cavity 125 of the housing 110. Access to a bin 220 may be provided by unlocking of the door 120 and release of the bin 220 to be accessed, such that the bin 220 moves together with the door. As the door 120 moves to the open position (shown in FIG. 2), the bin or bins 220 that have been released move with the door 120 to the accessible position. While the illustrated embodiment depicts bins 220 disposed within the cavity 125 of the housing 110, further example embodiments may include any such mechanism which segregates the medications received in the cavity from one another and is configured to preclude access to medications when the mechanism is in an inaccessible position. Such mechanisms may include clips which retain medications securely, or gates which preclude access, among other mechanisms. For purposes of the description, the bins, clips, gates, or other mechanisms for restricting access to an object, such as medication received therein may be generally referred to as "receivers."

Figure 3:
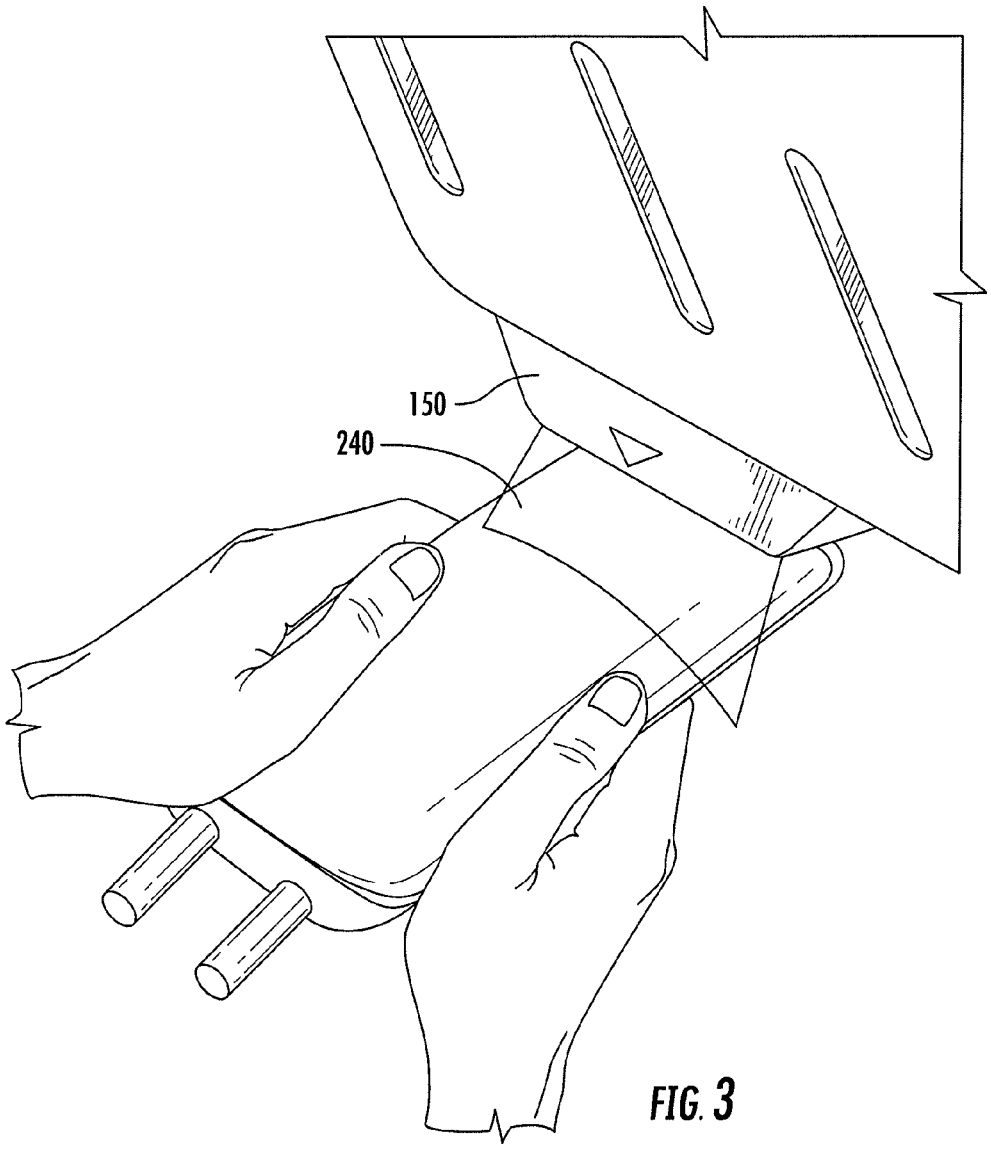
FIG. 3 illustrates a scanner which may be used in conjunction with example embodiments of the present invention.

In order to load medication into the receivers or bins 220 of the system 100, a technician may scan the identification of a medication to be loaded using scanner 150 as shown in FIG. 3. The scanner may read identifying indicia of the medication 240, such as a barcode or RFID tag in order to properly identify the medication. A patient identifier for whom the medication is intended may also be scanned or included in the identifying indicia of the medication. The scanned medication may then be inserted into a bin 220. The bin may be identified by the technician using the user interface 130 such that the identified medication is correlated to a particular bin. Optionally, the bins may each include a sensor to detect the presence of an article. In response to the scanning of identifying indicia of a medication and subsequent detection of a previously empty bin receiving contents therein, the bin may be automatically associated with the identified medication.

The technician may load medications to the system as needed for one or more patients. In some cases, the technician may be required to remove medications from the system, such as in the case of a discharged patient, a change in a patient's medication orders, the recall of a medication, or the expiration of a medication. In such an embodiment, the removed medication may be scanned by the scanner 150 to identify the medication such that the system acknowledges the removal of the medication by the technician. As the technician provided identification to access the system 100, an audit record may be stored of access to the system and the insertion and/or removal of medications. The audit record of access to a storage and dispensing system may be used for future audits of the handling of certain medications or to enable traceability of medications and their transport throughout a facility.

In some example embodiments, the scanned identifying indicia of a medication may include an expiration date, lot number, and/or refrigeration requirements of the medication. The system may be configured to monitor such medications such that upon expiration of a medication, recall of a lot of medication, or failure to meet the refrigeration requirements of a medication, the medication may be flagged for removal by a technician, and dispensing of the medication to an authorized medical person requesting the medication for administration may be prevented.

Once the technician has properly identified and loaded medications into the bins 220, the technician may close the door 120, thereby moving each of the bins 220 to an inaccessible position. The door 120 may be locked upon closure, and the contents of the system (i.e., the medications stored therein) are inaccessible and secure.

When a patient is in need of a medication, and an authorized medical person is available to dispense and administer the medication, the authorized medical person may engage the storage and dispensing system 100. The system may be conveniently located proximate the patient such that the authorized medical person does not have to walk very far to retrieve the necessary medication. According to some example embodiments, the storage and dispensing system 100 may be located in the room of the patient. The authorized medical person may identify themselves to the system 100 by interaction with the user interface 130 and/or the scanner 150. As with the identification of the technician, the system may perform a biometric scan at the user interface 130 to identify the authorized medical person, scan identification credentials at the scanner 150, receive a PIN at the user interface 130, or any combination of identification methods.

Upon identification and confirmation by the system 100 of the authorized medical person, the user interface may provide options for available medications to be retrieved. In some embodiments of the present invention, the system 100 may be configured to serve multiple patients such that an authorized medical person may select the patient via the user interface 130 for whom they are retrieving medication. Systems of example embodiments may also be configured to store medications for a plurality of time periods (e.g., morning, afternoon, evening) or various types of medications for a specific patient. As such, the authorized medical person may select the medication type and/or time period for which the requested medication is intended. Provided the authorized medical person is authorized to access the requested medication, the door 120 may be unlocked. Access to some or all of the bins or the door 120 may be precluded if the person attempting to access the medications is not authorized to access some or all of the medications stored therein or to administer medications to a particular patient.

Figure 4:
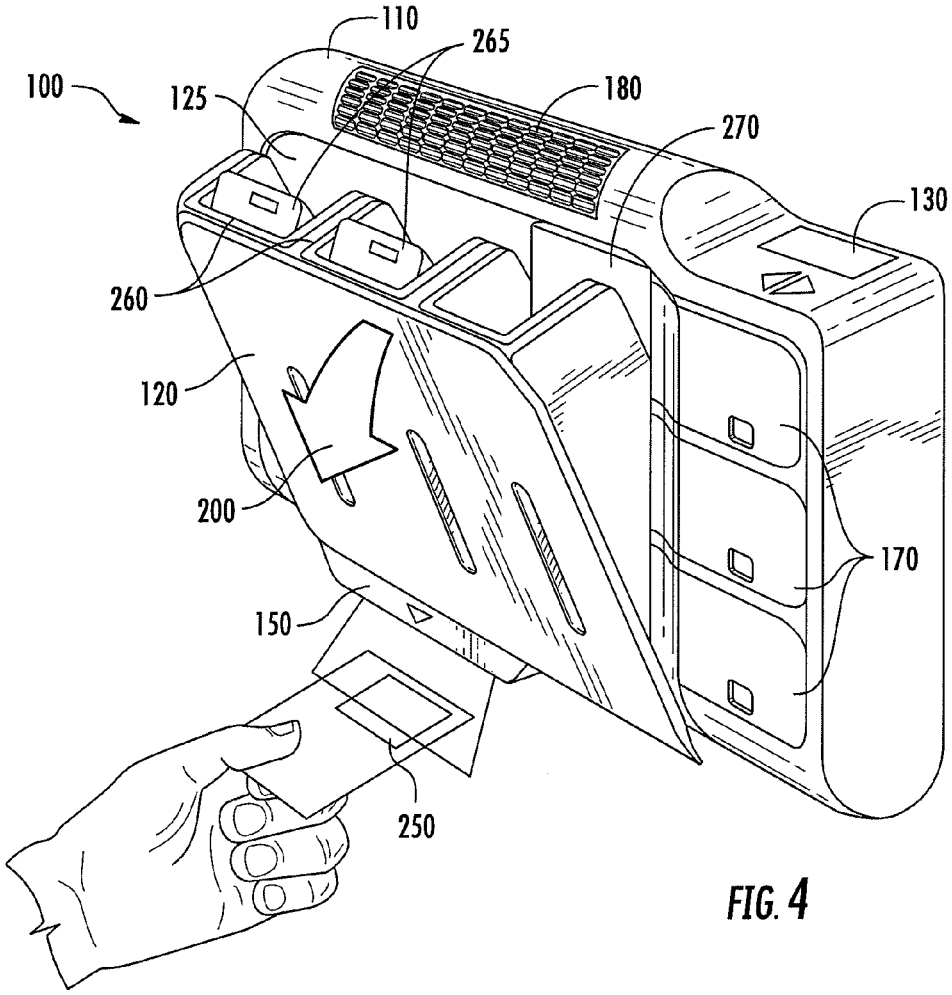
FIG. 4 illustrates the dispensing system of FIG. 1 with the door in the open position and some receivers in an accessible position according to an example embodiment of the present invention.

FIG. 4 illustrates an example embodiment of an authorized medical person scanning identifying credentials 250 and being granted access to bins 260 of the storage and dispensing system 100, which were previously held in the cavity 125. The bins 260 which are moved to the accessible position include contents of the request. In the illustrated embodiment, the request included two intravenous medication bags 265, each contained in a separate bin 260 of the system. A third bin 270 does not include a medication that was part of the request such that the third bin 270 remains in the inaccessible position within the cavity 125 of the housing 110. The authorized medical person may remove the medication 265 from bins 260 for administration to the patient. Optionally, the medication may be scanned by scanner 150 after removal from the bins to confirm that the medication removed was the medication that was requested. The storage and dispensing system may provide an alert confirming that the medication removed and scanned matches the medication of the request. The alert may include an audible alert, such as a tone, and/or a visual alert, such as illumination of a green light emitting diode (LED). An alert may also be provided if the medication removed and scanned does not match the medication of the request. Such an alert may be distinct from the alert confirming that the medication is correct, such as a red LED or a loud tone or buzz alerting the authorized medical person that something is wrong. An alert may also be provided if the medication is determined to be expired, recalled, or otherwise should not be used. After removal of the medication from the system 100, the door 120 may be closed returning the bins 260 to the inaccessible position and locking the door 120 in the closed position.

Figure 5:
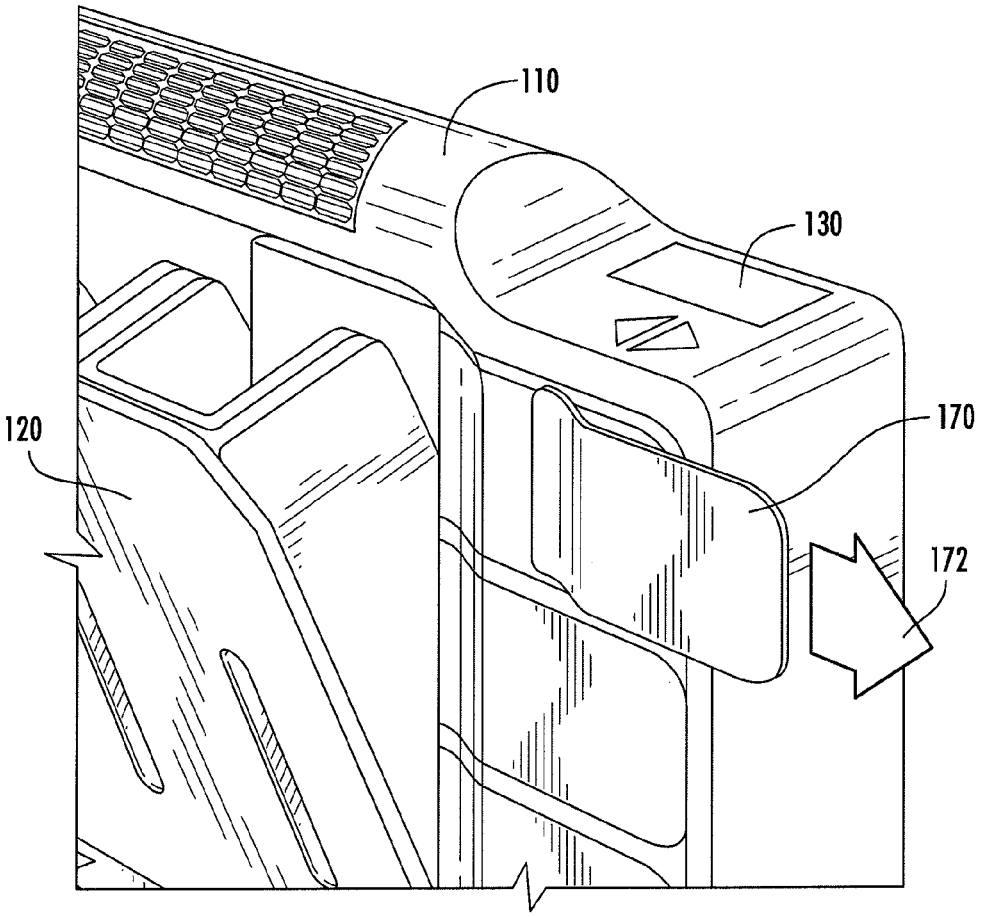
FIG. 5 illustrates the dispensing system of FIG. 1 with a secondary door moved to the open position according to an example embodiment of the present invention.

While example embodiments above have been described with respect to bins 260, 270 accessed through the door 120, FIG. 4 further illustrates secondary doors 170. The secondary doors 170, when opened, may provide access to shelves configured to hold other items which may include medication or supplies. The secondary doors 170 may be locked, precluding access to the contents of the shelves until an authorized medical person or technician is properly identified and requests the contents of one of the shelves. In response to such a request, the secondary door(s) 170 including the requested contents may be unlocked and the door 170 may be opened. FIG. 5 illustrates an example embodiment of a secondary door 170 moved to the open position along arrow 172. While the illustrated embodiment shows a sliding opening mechanism, a conventional hinged mechanism or any other mechanism may be used. The secondary doors 170 may be configured to open automatically in response to being unlocked, or may be opened manually by an authorized medical person.

Figure 6:
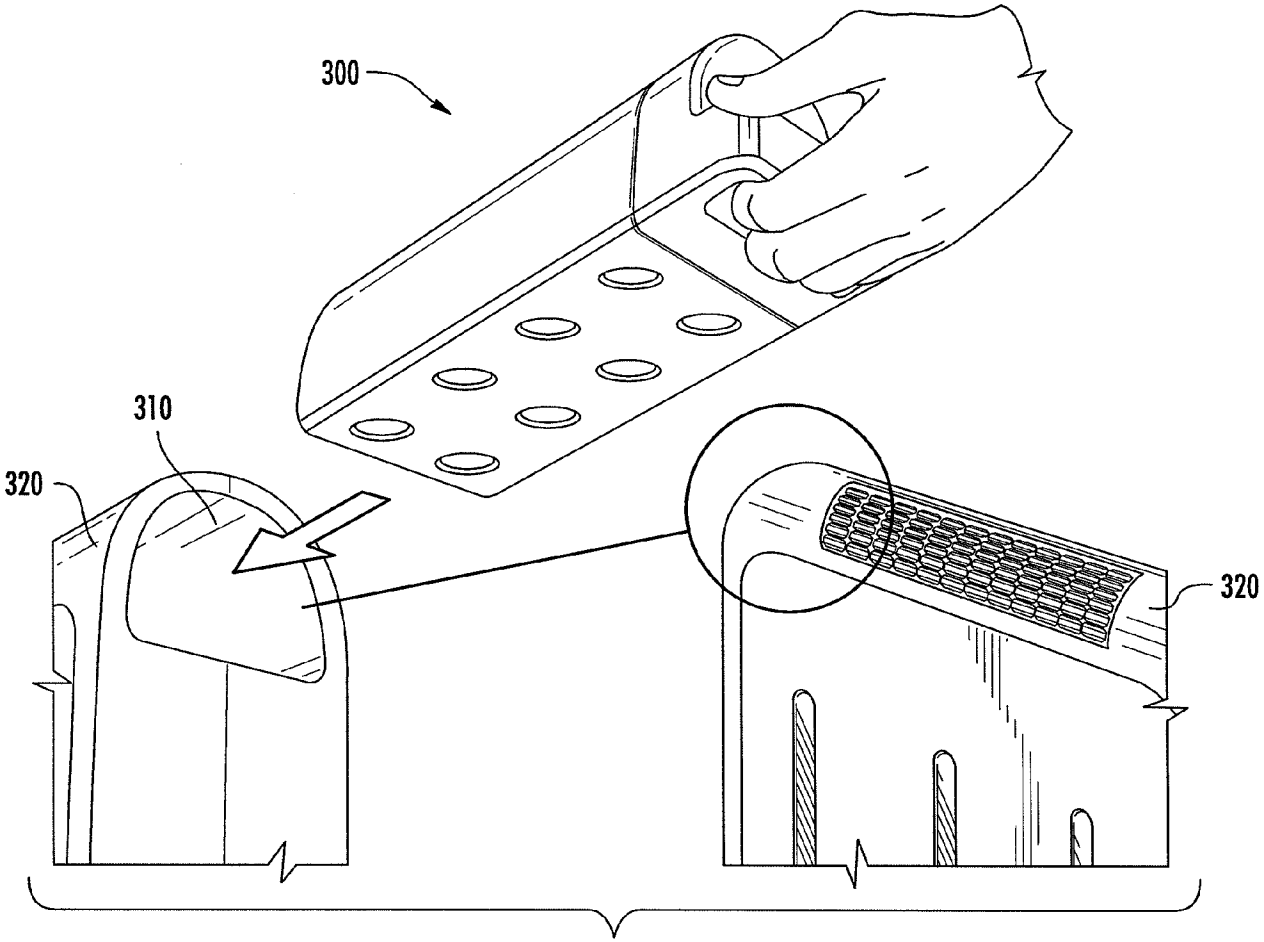
FIG. 6 illustrates a cooling pack as received into a cooling pack receiver of a dispensing system according to an example embodiment of the present invention.

Storage of medications proximate a patient may increase the efficiency of medication distribution as outlined above; however, some medications may require refrigeration in order to maintain their effectiveness. As such, example embodiments of the present invention may be configured with a mechanism for cooling the contents of the system. FIG. 6 illustrates an example embodiment of a mechanism for cooling the contents of a system in which a cooling pack 300 is inserted into a cooling pack receiver 310 of the housing 320 of an example system. The cooling pack receiver 310 may be in fluid communication with ducts configured to route cooling air from the cooling pack 300 to the contents of the housing 320. In some example embodiments, ducts may be opened or closed as needed to cool only those bins and/or shelves that contain medication that requires refrigeration. The ducts may be manually opened or closed, or optionally, upon the system scanning the medication, recognizing that it requires refrigeration, and identifying the bin that the medication is inserted into, the ducts may be opened automatically accordingly.

According to some example embodiments, the cooling pack receiver 310 may not include specific ducts, but instead a cooling pack 300 received within the cooling pack receiver 310 may cool all of the contents of the system. In still other embodiments, the cooling pack receiver may be configured such that a specific bin of the system is configured to be a refrigerated bin, while other bins may not be able to be cooled by the cooling pack. In such an embodiment, the cooling pack receiver 310 may be in fluid communication with only the bin configured to be cooled.

Figure 7:
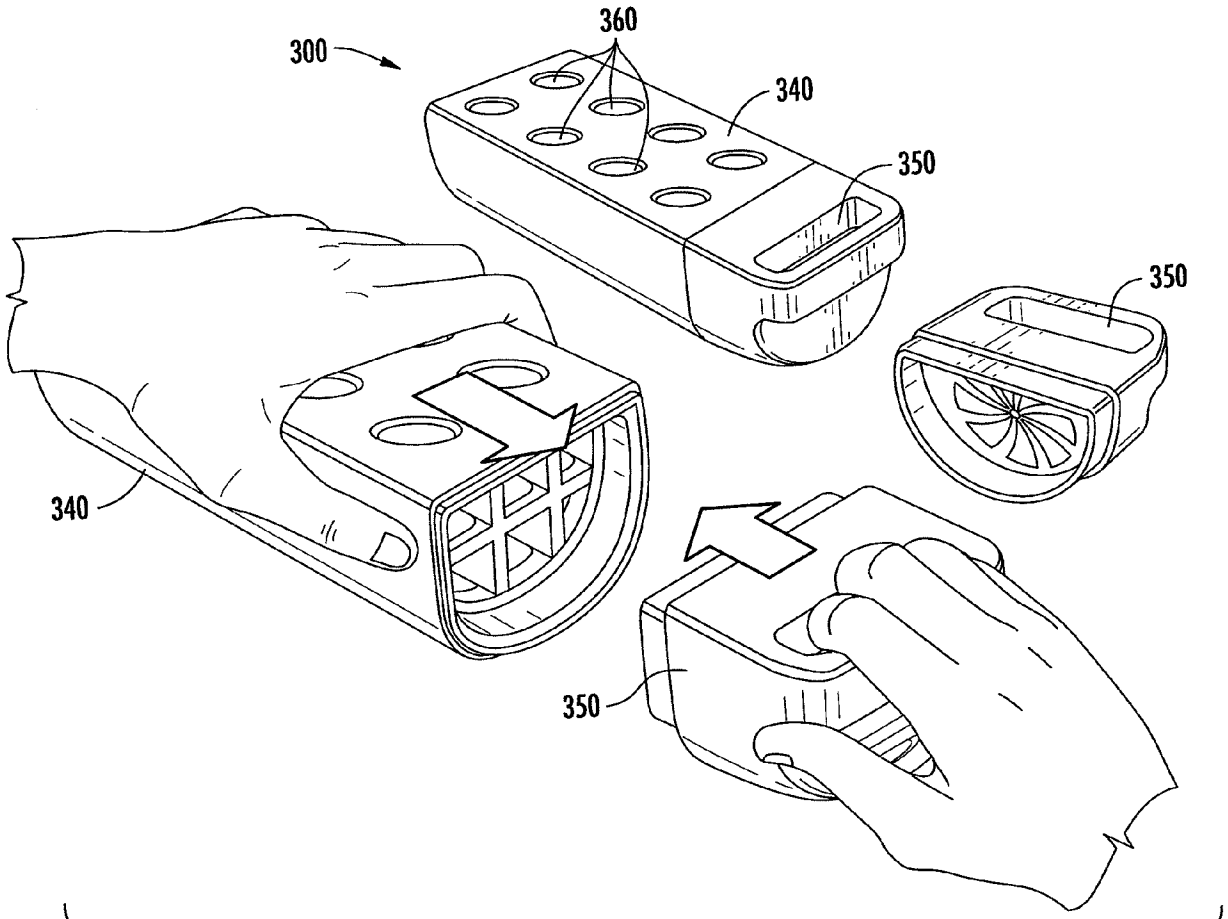
FIG. 7 illustrates a cooling pack according to an example embodiment of the present invention.

FIG. 7 illustrates a cooling pack 300 of example embodiments in which the cooling pack 300 includes a passive, cold body 340 and a powered fan module 350 configured to be removably attached to the cold body 340. The cold body 340 may be cooled in a refrigerator, or more preferably, a freezer, to cool the contents thereof. The cold body may include a material which maintains a cold temperature for an extended period of time, such as a temperature below 40 degrees Fahrenheit for a period of several hours. The material may include pellet membranes which may have a relatively large surface area compared to their size allowing for greater heat transfer from incoming air into the pellet membranes to cool the air flow. Materials used may be phase change materials encased in a membrane, such as a pellet membrane, to allow significant thermal transfer relative to the size of the cooled mass.

The cooling pack 300 of example embodiments may further include a powered fan module 350 which may be attached to the cold body 340. The powered fan module may include a battery configured to power a fan disposed therein to force air through the cooling body and out through vents 360, providing a cooled air stream through the vents 360 to at least a portion of the cavity of the system. The fan module may be detached from the cold body such that the fan module may be recharged while the cold body is cooled. When a cooling pack is needed, a technician may remove the cold body 340 from the cold storage (e.g., a freezer), remove a fan module 350 from the charger, and join the two together. When the cooling pack 300 is turned on or inserted into a cooling pack receiver 310 of a housing 320, the fan may run, forcing the cooling air over the pellet membranes and into the cavity of the housing 320.

In some example embodiments, the cooling pack may be used to provide power to the storage and dispensing system. For example, when medications are loaded into a housing 320, a cooling pack 300 may also be loaded in. The cooling pack 300 may include a battery of sufficient power to provide cooling (if necessary) and to power the user interface and lock mechanisms of the storage and dispensing system. In such an embodiment, the battery of the cooling pack may be charged as described above, and replaced within the housing 320 each time a technician loads medication into the housing.

In other example embodiments, the cooling pack may not require a powered fan to facilitate cooling of the contents of the housing 320, but may rely on convection to cool the medications within the housing. Optionally, the housing may include a fan to drive air flow over a non-powered cooling pack in order to actively cool the contents of the housing.

Described herein is an example embodiment of a method of distributing medications to storage and dispensing systems of example embodiments of the present invention in a healthcare facility. A technician or a central pharmacy distribution center may receive medication orders for a plurality of patients. The orders may include patient names, medications, doses, quantities, etc. In one example embodiment, the technician may retrieve the medications for the order, retrieve a printed label for the medication, and place the label on the medication. Optionally, an automated system may prepare medications to fill the medication order by retrieving and labeling the medication appropriately using an automated, or semi-automated process. The appropriately labeled medication may then be loaded to a cart for transport to the appropriate location in the healthcare facility. A medication label may be scanned prior to loading into a cart, for example, a cart may include a user interface which includes a scanner for reading identifying indicia from the medication. Upon scanning of the medication, it may be loaded to the cart. The user interface of the cart may provide an indication of the location on the cart where the medication should be placed. The location may be proximate other medications that are intended to be distributed to the same, or similar locations.

The scanning and loading of medication may continue until all of the medications for a facility or unit of a facility are loaded to the cart. Optionally, scanning and loading may continue until the cart has reached capacity. During the scanning of medication, the user interface of the cart may indicate that one or more of the scanned medications requires refrigeration. The user interface may indicate to the technician that one or more cooling packs will be required for distribution with the medications. Upon retrieving the cooling packs and loading them onto the cart, the cart may be ready to be used to distribute the medications stored therein. As the cart may hold medications only for a short time (e.g., during delivery), the medications may not require refrigeration. However, one or more locations on the cart may be refrigerated or cooled for the storage of medications. Cooling may be performed by a cooling pack of example embodiments.

During distribution, a technician may move the cart throughout a healthcare facility. Upon arrival at a healthcare facility unit, the technician may encounter a storage and dispensing system of example embodiments of the present invention. The technician may scan or otherwise indicate to the user interface of the cart the identification of the storage and dispensing system they are near. The user interface may provide an indication of the medications needed for distribution to the system and may provide the locations on the cart where the medications may be found. The user interface may also indicate whether a cooling pack is needed for the storage and dispensing system housing. As outlined above, the technician may identify themselves to the system through the scanner (e.g., scanner 150 of FIG. 2) and the user interface (e.g., user interface 130 of FIG. 2). In response the door of the housing may be opened and the bins therein may become accessible, allowing the technician to scan and load medications into the system.

Example embodiments of the present invention may be configured to provide an audit trail of medication from the central pharmacy to the patient. As outlined above, each movement of the medication may be identified by a scanning operation, and each movement or scanning operation may be associated with an authorized medical person. In this manner, medications, particularly controlled substances, may be monitored throughout a healthcare facility and the responsible medical person may also be identified. Such control may ensure compliance with applicable legal requirements for handling medications in a facility and may provide records of medication transactions that can be monitored and reviewed as required.

Systems of example embodiments may include wireless communications with one or more networks of the healthcare facility. The system may interface with a network of a healthcare facility to ensure accurate dispensing of medication to authorized personnel. Changes in medication orders, patient status, and other information may be communicated via the network to ensure proper medication distribution from the system.

The transfer of data and information between a storage and dispensing system of example embodiments and a healthcare facility network may be implemented in various embodiments of the present invention. As used herein, where a computing device is described herein to receive data from another computing device, such as receiving an indication of medication requested at the user interface, it will be appreciated that the data may be received directly from the another computing device and/or may be received indirectly via one or more intermediary computing devices, such as, for example, one or more servers, relays, routers, network access points, and/or the like. Similarly, where a computing device is described herein to send data to another computing device, it will be appreciated that the data may be sent directly to the another computing device or may be sent to the another computing device via one or more interlinking computing devices, such as, for example, one or more servers, relays, routers, network access points, and/or the like.

In some example embodiments, processes and steps of the invention may be carried out by computing devices that may be in communication with a network, such as an information network of a healthcare facility. The computing devices may include storage and dispensing systems, nurse carts, technician carts, portable communications stations, or the like. Such a network may be embodied in a local area network, the Internet, any other form of a network, or in any combination thereof, including proprietary private and semi-private networks and public networks. The network may comprise a wire-line network, wireless network (e.g., a cellular network, wireless local area network, wireless wide area network, some combination thereof, or the like), or a combination thereof, and in some example embodiments comprises at least a portion of the Internet.

In some example embodiments, computing devices configured to perform various operations of the invention may include computing devices, such as, by way of non-limiting example, a server, configured to access a network and/or server(s). In some example embodiments, computing devices may be implemented as a distributed system or a cloud based entity that may be implemented within a network. In this regard, a computing device according to the present invention may comprise one or more servers, a server cluster, one or more network nodes, a cloud computing infrastructure, some combination thereof, or the like. Additionally or alternatively, embodiments may be implemented as a web service. Such a system may be implemented to monitor, track, and audit medication distribution throughout a facility. Further, an example embodiment of such a system may be configured to alert medical personnel of medication recalls, changes in medication orders for a patient, or other real-time changes that may affect the dispensing and administration of medications from a storage and dispensing system of example embodiments.

The computing device of example embodiments may include processing circuitry. The processing circuitry may be configured to perform actions in accordance with one or more example embodiments disclosed herein. In this regard, the processing circuitry may be configured to perform and/or control performance of one or more functionalities of the handling, transporting, storing, or dispensing of medications and/or supplies in accordance with various example embodiments. The processing circuitry may be configured to perform data processing, application execution, and/or other processing and management services according to one or more example embodiments. In some embodiments, computing device or a portion(s) or component(s) thereof, such as the processing circuitry, may be embodied as or comprise a circuit chip. The circuit chip may constitute means for performing one or more operations for providing the functionalities described herein.

Figure 8:
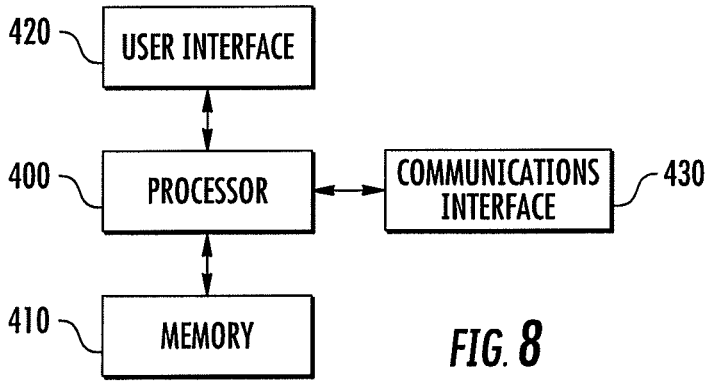
FIG. 8 is a schematic diagram of an apparatus which may be implemented as a part of a dispensing system or a user interface of a dispensing system according to example embodiments of the present invention.

A schematic illustration of an apparatus which may be implemented as at least a part of a dispensing system or user interface of a storage and dispensing system is illustrated in FIG. 8. As shown, in some example embodiments, the processing circuitry may include a processor 400 and, in some embodiments, may further include memory 410. The processing circuitry may be in communication with, include or otherwise control a user interface 420 and/or a communication interface 430. As such, the processing circuitry may be embodied as a circuit chip (e.g., an integrated circuit chip) configured (e.g., with hardware, software, or a combination of hardware and software) to perform operations described herein.

The processor 400 may be embodied in a number of different ways. For example, the processor may be embodied as various processing means such as one or more of a microprocessor or other processing element, a coprocessor, a controller, or various other computing or processing devices including integrated circuits such as, for example, an ASIC (application specific integrated circuit), an FPGA (field programmable gate array), or the like. Although illustrated as a single processor, it will be appreciated that the processor may comprise a plurality of processors. The plurality of processors may be in operative communication with each other and may be collectively configured to perform one or more functionalities of a system for handling, storing, transporting, or distributing medication as described herein. The plurality of processors may be embodied on a single computing device or distributed across a plurality of computing devices. In some example embodiments, the processor may be configured to execute instructions stored in the memory or otherwise accessible to the processor. As such, whether configured by hardware or by a combination of hardware and software, the processor may represent an entity (e.g., physically embodied in circuitry—in the form of processing circuitry) capable of performing operations according to embodiments of the present invention while configured accordingly. Thus, for example, when the processor is embodied as an ASIC, FPGA, or the like, the processor may be specifically configured hardware for conducting the operations described herein. Alternatively, as another example, when the processor is embodied as an executor of software instructions, the instructions may specifically configure the processor to perform one or more operations described herein.

In some example embodiments, the memory 410 may include one or more non-transitory memory devices such as, for example, volatile and/or non-volatile memory that may be either fixed or removable. In this regard, the memory 410 may comprise a non-transitory computer-readable storage medium. It will be appreciated that while the memory 410 is illustrated as a single memory, the memory may comprise a plurality of memories. The plurality of memories may be embodied on a single computing device or may be distributed across a plurality of computing. The memory may be configured to store information, data, applications, instructions and/or the like for enabling embodiments of the present invention to carry out various functions in accordance with one or more example embodiments. For example, the memory may be configured to buffer input data for processing by the processor. Additionally or alternatively, the memory may be configured to store instructions for execution by the processor. As yet another alternative, the memory may include one or more databases that may store a variety of files, contents, or data sets. Among the contents of the memory, applications may be stored for execution by the processor to carry out the functionality associated with each respective application.

A user interface 420 of example embodiments, such as the user interface of a dispensing system, may be in communication with the processing circuitry to receive an indication of a user input at the user interface and/or to provide an audible, visual, mechanical, or other output to the user. As such, the user interface may include, for example, a user input interface 420 such as a keyboard, a mouse, a joystick, a display, a touch screen display, a microphone, a speaker, and/or other input/output mechanisms. As such, the user interface may 420, in some example embodiments, provide means for user control of embodiments of the present invention. In some example embodiments in which the invention is embodied as a server, cloud computing system, or the like, aspects of user interface may be limited or the user interface may not be present. In some example embodiments, one or more aspects of the user interface may be implemented on a user terminal. Accordingly, regardless of implementation, the user interface may provide input and output means to facilitate handling, storing, transporting, or dispensing of medication in accordance with one or more example embodiments.

The communication interface 430 may include one or more interface mechanisms for enabling communication with other devices and/or networks. In some cases, the communication interface may be any means such as a device or circuitry embodied in either hardware, or a combination of hardware and software that is configured to receive and/or transmit data from/to a network and/or any other device or module in communication with the processing circuitry. By way of example, the communication interface 430 may be configured to enable embodiments of the present invention to communicate with application server(s) and/or networks and/or information databases. Accordingly, the communication interface may, for example, include supporting hardware and/or software for enabling communications via cable, digital subscriber line (DSL), universal serial bus (USB), Ethernet, or other methods.

Figure 9:
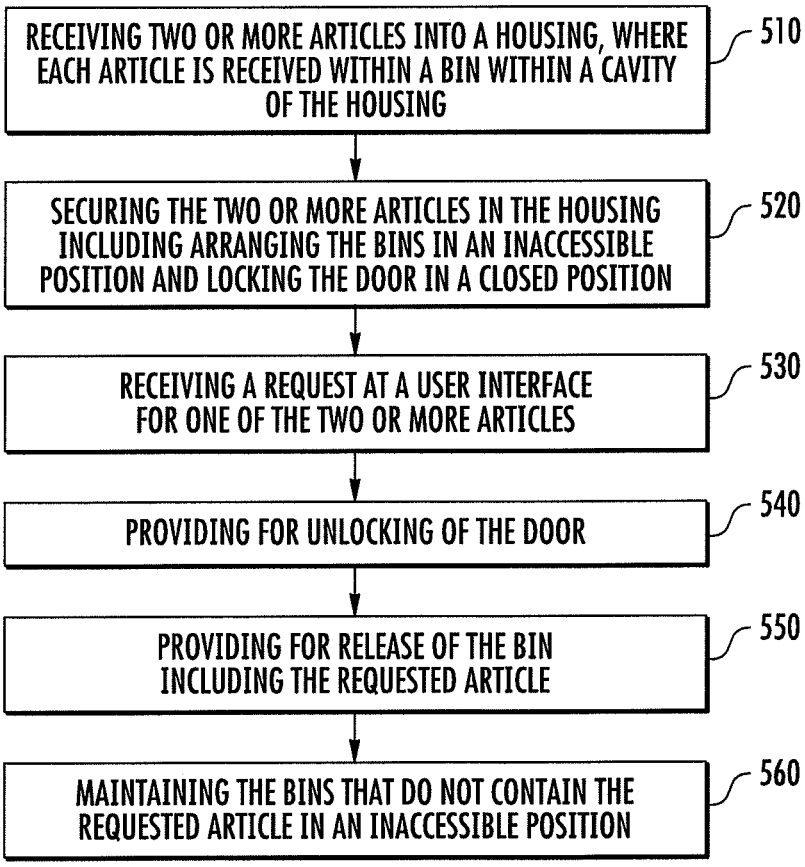
FIG. 9 is a flowchart of a method of implementing a dispensing system of example embodiments of the present invention.

FIG. 9 is a flowchart of a method and program product according to an example embodiment of the present invention. It will be understood that some blocks of the flowchart and combinations of blocks in the flowchart may be implemented by various means, such as hardware, firmware, processor, circuitry, and/or other devices associated with execution of software including one or more computer program instructions. These computer program instructions may also be stored in a non-transitory computer-readable memory that may direct a computer or other programmable apparatus to function in a particular manner, such that the instructions stored in the computer-readable memory produce an article of manufacture which implements the functions specified in the flowchart blocks. The computer program instructions may also be loaded onto a computer or other programmable apparatus to cause a series of operations to be performed on the computer or other programmable apparatus to produce a computer-implemented process such that the instructions which execute on the computer or other programmable apparatus implement the functions specified in the flowchart block(s).

Accordingly, blocks of the flowchart support combinations of means for performing the specified functions and combinations of operations for performing the specified functions. It will also be understood that one or more blocks of the flowchart, and combinations of blocks in the flowchart, can be implemented by special purpose hardware-based computer systems which perform the specified functions, or combinations of special purpose hardware and computer instructions.

In this regard, a method according to one embodiment of the invention, as shown in FIG. 9, may include receiving two or more articles into a housing, where each article is received within a bin within a cavity of the housing at 510. The method may include securing the two or more articles in the housing, including arranging the bins in an inaccessible position and locking the door in the closed position at 520. A request may be received at a user interface for one of the two or more articles at 530. In response to receiving the request, the door may be unlocked at 540. The bin including the requested article may be released at 550. The bins that do not contain the requested article may be maintained in the inaccessible position at 560.

In some embodiments, certain ones of the operations may be modified or further amplified as described below. Moreover, in some embodiments additional operations may also be included. It should be appreciated that each of the modifications, optional additions, or amplifications below may be included with the operations above either alone or in combination with any others among the features described herein. With reference to the method of FIG. 9, in some example embodiments, an identifier of an article removed from the bin may be received. The identifier of the article removed may be compared to the one of the two or more articles requested. A notification may be provided in response to the identifier of the article removed matching the one of the two or more requested articles.

In an example embodiment, an apparatus for performing the method of FIG. 9 may include a processor configured to perform some or all of the operations (510-560) described above. The processor may, for example, be configured to perform the operations (510-560) by performing hardware implemented logical functions executing stored instructions, or executing algorithms for performing each of the operations. Alternatively, the apparatus may include means for performing each of the operations described above.

An example of an apparatus according to an example embodiment may include at least one processor and at least one memory including computer program code. The at least one memory and the computer program code may be configured to, with the at least one processor, cause the apparatus to perform the operations 510-560 (with or without the modifications and amplifications described above in any combination).

An example of a computer program product according to an example embodiment may include at least one computer-readable storage medium having computer-executable program code portions stored therein. The computer-executable program code portions may include program code instructions for performing operations 510-560 (with or without the modifications and amplifications described above in any combination).

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe example embodiments in the context of certain example combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. Although specific terms are employed herein, they are used in a generic and descriptive sense only and not for purposes of limitation.

That which is claimed:

1. An apparatus comprising:

a housing defining a cavity;

a door, wherein the door is movable between an open position and a closed position relative to the housing, wherein in the open position the cavity of the housing is accessible;

two or more receivers disposed within the cavity, wherein each receiver is configured to hold an article for a patient, wherein each of the receivers is movable between an accessible position, in which the contents of the receiver are accessible, and an inaccessible position, in which the contents of the receiver are inaccessible;

a lock configured to lock the door in the closed position; and a user interface configured to receive a request from a user, wherein the request identifies the contents of one of the receivers;

wherein, in response to the request received at the user interface, the door is unlocked, wherein the receiver including the contents identified by the request is moved to the accessible position in response to the door being moved to the open position, and wherein the one or more receivers not including the contents identified by the request remain in the inaccessible position in response to the door being moved to the open position.

2. The apparatus of claim 1, wherein the receiver including the contents identified by the request is engaged by the door, and wherein the receiver including the contents identified by the request is moved to the accessible position as the door is moved to the open position.

3. The apparatus of claim 1, wherein the user interface is further configured to receive a restock request to access each of the two or more receivers disposed within the cavity, and wherein in response to the restock request to access each of the two or more receivers, each of the receivers is moved to the accessible position in response to the door moving to the open position.

4. The apparatus of claim 1, further comprising two or more windows in the door, wherein each of the two or more windows corresponds to one of the two or more receivers disposed within the cavity, and wherein presence of the contents of each of the receivers is visible through a respective window.

5. The apparatus of claim 1, further comprising a photovoltaic panel disposed on the housing configured to charge a battery disposed within the housing.

6. The apparatus of claim 5, wherein the user interface and the lock are configured to be powered by the battery.

7. The apparatus of claim 1, wherein the housing further comprises a cooling pack receiver configured to receive therein a cooling pack.

8. The apparatus of claim 7, wherein the housing further comprises one or more ducts from the cooling pack receiver to a respective one or more of the two or more receivers for directing cooling air to one or more of the receivers.

9. The apparatus of claim 8, further comprising a cooling pack configured to be received into the cooling pack receiver, wherein the cooling pack comprises a passive, cold body and a powered fan configured to move air across the cold body and into the cavity of the housing.

10. The apparatus of claim 1, further comprising a reader configured to read identifying indicia of an article to be received within a receiver of the apparatus.

11. The apparatus of claim 10, wherein the reader is further configured to read identifying indicia of an article removed from a receiver of the apparatus.

12. The apparatus of claim 11, wherein the apparatus is configured to compare the identifying indicia of the article removed from a receiver of the apparatus to the request received at the user interface.

13. The apparatus of claim 12, wherein the apparatus is configured to provide an alert in response to the identifying indicia of the article matching the request received at the user interface, wherein the notification is at least one of an audible alert or a visual alert.

14. A method comprising:

receiving, at a housing, two or more articles, wherein each article is received within a receiver within a cavity of the housing, wherein the articles are each received within a receiver arranged in an accessible position through a door arranged in an open position;

securing the two or more articles in the housing, wherein securing comprises arranging the receivers in an inaccessible position and locking the door in a closed position;

receiving a request at a user interface of the housing for one of the two or more articles received within the housing;

providing for unlocking of the door;

providing for release of the receiver including the requested article, wherein in response to the door being moved to the open position, the receiver including the requested article is moved to the accessible position; and maintaining the receivers that do not contain the requested article in an inaccessible position in response to the door being moved to the open position.

15. The method of claim 14, wherein receiving the two or more articles comprises reading identifying indicia of each of the two or more articles and receiving a respective receiver identifier for the receiver into which each of the two or more articles are received.

16. The method of claim 15, wherein in response to receiving a request at a user interface for one of the articles, providing for release of the receiver comprising the receiver identifier that corresponds to the one of the articles requested.

17. The method of claim 14, further comprising:

receiving an identifier of an article removed from the receiver including the requested article;

comparing the identifier of the article removed to the one of the two or more articles requested; and providing a notification in response to the identifier of the article removed matching the one of the two or more articles requested.

18. The method of claim 17, wherein the notification comprises at least one of an audible alert or a visual alert.

19. The method of claim 14, further comprising providing for cooling of at least one of the receivers in the cavity of the housing.

20. A system comprising:

a housing defining a cavity and a cooling pack receiver;

a door, wherein the door is configured to be movable between an open position and a closed position relative to the housing, wherein two or more articles for patients are received within the cavity, wherein the articles are movable between an accessible position and an inaccessible position;

a lock configured to lock the door in the closed position;

a cooling pack received within the cooling pack receiver, wherein the cooling pack cools at least one of the two or more articles received within the cavity; and a user interface configured to receive a request from a user, wherein the request identifies at least one of the two or more articles for patients;

wherein, in response to the request received at the user interface, the door is configured to be unlocked, wherein the at least one of the two or more articles for patients identified by the request is moved to an accessible position in response to the door being moved to the open position, and wherein at least one of the two or more articles for patients that is not identified by the request is maintained in an inaccessible position in response to the door being moved to the open position.

* * * * *